US008613323B2

(12) United States Patent
Garbett et al.

(10) Patent No.: US 8,613,323 B2
(45) Date of Patent: Dec. 24, 2013

(54) WELLHEAD ASSEMBLY

(75) Inventors: Keith Garbett, Spring, TX (US); Andrew Bean, Bradford (GB); Hans Paul Hopper, Aberdeen (GB)

(73) Assignee: Cameron International Corporation, Houston, TX (US)

( * ) Notice: Subject to any disclaimer, the term of this patent is extended or adjusted under 35 U.S.C. 154(b) by 745 days.

(21) Appl. No.: 12/377,817

(22) PCT Filed: Aug. 17, 2007

(86) PCT No.: PCT/GB2007/003149

§ 371 (c)(1),
(2), (4) Date: Aug. 10, 2010

(87) PCT Pub. No.: WO2008/020232

PCT Pub. Date: Feb. 21, 2008

(65) Prior Publication Data

US 2010/0300700 A1 Dec. 2, 2010

(30) Foreign Application Priority Data

Aug. 18, 2006 (GB) ..... 0616423.0

(51) Int. Cl.
*E21B 43/01* (2006.01)

(52) U.S. Cl.
USPC ..... 166/368; 166/338; 166/344; 166/360; 166/379; 166/85.1

(58) Field of Classification Search
USPC ..... 166/368, 338, 341, 344, 351, 360, 378, 166/379, 85.1, 85.4; 285/123.1
See application file for complete search history.

(56) References Cited

U.S. PATENT DOCUMENTS

| | | | | | |
|---|---|---|---|---|---|
| 5,280,766 | A | * | 1/1994 | Mohn | 166/368 |
| 5,544,707 | A | * | 8/1996 | Hopper et al. | 166/382 |
| 5,992,527 | A | * | 11/1999 | Garnham et al. | 166/379 |
| 6,015,013 | A | * | 1/2000 | Edwards et al. | 166/360 |
| 6,039,119 | A | * | 3/2000 | Hopper et al. | 166/368 |

(Continued)

FOREIGN PATENT DOCUMENTS

| | | |
|---|---|---|
| EP | 0719905 A1 | 7/1996 |
| EP | 0989283 A2 | 3/2000 |

(Continued)

OTHER PUBLICATIONS

PCT/GB2007/003149 International Search Report and Written Opinion, Feb. 15, 2008.

(Continued)

*Primary Examiner* — Matthew Buck
(74) *Attorney, Agent, or Firm* — Chamberlain Hrdlicka

(57) ABSTRACT

An assembly for use on a wellhead includes a tree body including an internal main bore arranged in use to be aligned with the bore of a wellhead housing; the tree body including a lateral bore extending through the tree body from the internal bore; the tree body further including means for connecting to a connector so as to align the internal bore of the tree body with an internal bore in the connector, in use the tree body and the connector together forming a horizontal tree. The tree body may include one or more integrally formed bores and valves to provide fluid flowpaths for the annulus and/or crossover functions. A wellhead assembly including the tree assembly is also provided.

36 Claims, 6 Drawing Sheets

(56) References Cited

U.S. PATENT DOCUMENTS

| | | | | |
|---|---|---|---|---|
| 6,050,339 | A * | 4/2000 | Milberger | 166/368 |
| 6,053,252 | A * | 4/2000 | Edwards | 166/348 |
| 6,062,314 | A * | 5/2000 | Nobileau | 166/368 |
| 6,076,605 | A * | 6/2000 | Lilley et al. | 166/368 |
| 6,470,968 | B1 * | 10/2002 | Turner | 166/348 |
| 6,547,008 | B1 * | 4/2003 | Hopper et al. | 166/348 |
| 6,581,691 | B1 * | 6/2003 | Jennings et al. | 166/348 |
| 6,675,900 | B2 * | 1/2004 | Baskett et al. | 166/379 |
| 6,715,554 | B1 * | 4/2004 | Cunningham et al. | 166/348 |
| 6,805,200 | B2 * | 10/2004 | DeBerry | 166/347 |
| 6,810,954 | B2 * | 11/2004 | Garrett et al. | 166/77.51 |
| 6,823,941 | B2 * | 11/2004 | Donald | 166/368 |
| 6,988,553 | B2 * | 1/2006 | DeBerry | 166/347 |
| 7,032,673 | B2 * | 4/2006 | Dezen et al. | 166/341 |
| 7,201,229 | B2 * | 4/2007 | White et al. | 166/368 |
| 7,331,396 | B2 * | 2/2008 | Reimert et al. | 166/368 |
| 7,740,074 | B2 * | 6/2010 | White et al. | 166/347 |
| 2001/0011593 | A1 | 8/2001 | Wilkins | |
| 2003/0111228 | A1 | 6/2003 | Garrett et al. | |
| 2003/0116327 | A1 * | 6/2003 | Hopper et al. | 166/382 |
| 2003/0226666 | A1 * | 12/2003 | Fenton et al. | 166/368 |
| 2004/0094311 | A2 * | 5/2004 | Hopper et al. | 166/382 |
| 2004/0112604 | A1 * | 6/2004 | Milberger et al. | 166/368 |
| 2004/0140124 | A1 * | 7/2004 | Fenton et al. | 175/7 |
| 2004/0251036 | A1 * | 12/2004 | Hopper et al. | 166/384 |
| 2005/0121198 | A1 * | 6/2005 | Andrews | 166/368 |
| 2005/0155774 | A1 * | 7/2005 | Hopper et al. | 166/382 |
| 2005/0173122 | A1 * | 8/2005 | Hopper et al. | 166/348 |

FOREIGN PATENT DOCUMENTS

| | | | |
|---|---|---|---|
| EP | 1 233 145 | A2 | 8/2002 |
| GB | 2440940 | B | 12/2009 |
| GB | 2462219 | A | 2/2010 |
| GB | 2472738 | B | 5/2011 |
| GB | 2472739 | B | 5/2011 |
| WO | 9918329 | A1 | 4/1999 |
| WO | 0155550 | A1 | 8/2001 |
| WO | 03050384 | A1 | 6/2003 |
| WO | 2007054664 | A1 | 5/2007 |

OTHER PUBLICATIONS

Singapore Search Report for Application No. 201003841-2, dated Sep. 21, 2012.

Written Opinion received from the Australian Patent Office for Application No. SG 200900732-9, dated Sep. 17, 2009.

Examination Report received from the Australian Patent Office for Application No. SG 200900732-9, dated Jul. 2, 2010.

* cited by examiner

WELLHEAD ASSEMBLY

CROSS-REFERENCE TO RELATED APPLICATIONS

This application is a national phase entry of prior PCT Application No. PCT/GB2007/003149, filed 17 Aug. 2007, and entitled Wellhead Assembly, hereby incorporated herein by reference, which claims the benefit of UK Patent Application No. 0616423.0, filed 18 Aug. 2006, and entitled Wellhead Assembly, hereby incorporated herein by reference.

STATEMENT REGARDING FEDERALLY SPONSORED RESEARCH OR DEVELOPMENT

Not Applicable.

BACKGROUND

The present invention relates to a wellhead assembly, for example a wellhead completion assembly, and to a horizontal tree (also referred to as a Spool Tree™) for use in such an assembly. The invention is particularly concerned with assemblies for use in subsea wellhead installations.

It is well known in the art of oil and gas exploration and production for wells to be cased and suspended from a wellhead housing. Once the well has been completed and production is to begin, it is conventional practice to install a so-called Christmas tree on the wellhead housing, the Christmas tree having a bore therethrough in communication with the well and through which fluids from the well are produced. Conventionally, the Christmas tree is provided with one or more vertical bores. Access to the well while the Christmas tree is in place is provided by the one or more vertical bores. However, the access for downhole tools to enter the well is limited by the diameter of the vertical bore or bores in the Christmas tree. In the past, this has served as a major constraint to the downhole operations that may be performed with the Christmas tree in place on the wellhead housing.

These and other problems of conventionally designed Christmas trees and wellhead assemblies were overcome by the introduction of a horizontal tree or so-called Spool Tree. In the horizontal tree, production fluids leave the central bore of the tree through a port extending laterally through the tree wall. Should access be required to the well during production, tools may be passed through the central bore, for example through a conventional blowout preventer (BOP) located on top of the horizontal tree. Due to the relatively larger diameter of the bore of the horizontal tree, access to the well through the tree is significantly improved, compared with the conventional vertical tree design. This obviates the need to remove the tree when downhole operations are required, a dangerous task, in particular when dealing with subsea wellhead installations which may be a considerable distance below the surface of sea and, hence, from the rig or platform servicing them.

Examples of known tree and wellhead assemblies are disclosed in US 2005/0121198, U.S. Pat. Nos. 6,581,691, 6,547,008 and 5,544,707.

US 2005/0121198 discloses a subsea production system having a Christmas tree. The tree comprises a vertical bore with a hub at its upper end. Production and annulus valves are connected to the tree by means of separate valve blocks.

U.S. Pat. No. 6,581,691 discloses a landing adapter for soft landing a tubing hanger in the bore of a production tree or wellhead housing. Again, U.S. Pat. No. 6,581,691 discloses a wellhead tree having an integral connection hub. A plurality of valves are provided, some of which are internal to the tree and others of which are external and connected to the tree by way of one or more valve blocks.

A wellhead tree with a vertical bore and integral connector hub is disclosed in U.S. Pat. No. 6,547,008. The tree is provided with production and annulus valves that are external to the tree and bolted to the outer wall of the tree. A similar arrangement is shown in U.S. Pat. No. 5,544,707.

Further, EP 0 719 905 and EP 0 989 283 both describe a particularly advantageous horizontal tree and wellhead assembly. The wellhead described comprises a wellhead housing, to which a spool tree is connected by means of a conventional connector assembly. The spool tree is of a generally vertical arrangement, having a central longitudinal bore therethrough of relatively large diameter. A production port extends laterally from the central bore through the wall of the spool tree. A production valve block, typically including a production wing valve, is bolted to the side of the spool tree body so as to communicate with the production port. The upper end of the spool tree body terminates in a vertical intervention hub, to which may be connected a BOP using a conventional drilling connector. A set of annulus valves are also connected to the outside of the spool tree body, so as to communicate and align with a series of annulus ports extending through the spool tree body and communicating with the central bore of the tree.

More recent developments to the concept of the horizontal tree disclosed in EP 0 719 and EP 0 989 283 are described in U.S. Pat. No. 6,050,339. The horizontal tree disclosed in U.S. Pat. No. 6,050,339 comprises a vertically oriented longitudinal central bore. The tree is connected at its lower end to a wellhead housing. The upper end of the tree body is formed as a connector or hub, for connection to a BOP and a drilling riser or the like. A production port extends laterally through the body of the tree from the central bore. A production valve is incorporated into the tree body for controlling the flow of production fluids from the well. Similarly, annulus ports extend through the tree body to communicate between the central bore and the exterior. Valves incorporated into the tree body control the flow of fluid through the annulus ports.

U.S. Pat. No. 6,470,968 discloses a subsea tree and tubing hanger system. The subsea tree is of the horizontal arrangement, having a vertically oriented central bore, from which extends a lateral production port through the body of the tree to a production valve bolted onto the exterior of the tree body.

More recently, US 2004/0112604 discloses a horizontal spool tree with improved porting. Again, the tree comprises a vertically oriented central bore. The tree body is connected at its lower end to a wellhead housing, while its upper end forms a connector or hub for connection to a riser, BOP stack or the like. A lateral production port extends from the central bore through the tree body. A production flow valve is included in the tree body to control the flow of production fluids. However, a second production valve for controlling the production fluid flow is housed in a block bolted to the exterior of the tree body. Similarly, annulus ports are provided through the tree body, with an integral flow valve. However, a second annulus flow valve is located in a block bolted to the exterior of the tree body.

Since their inception in the early 1990's, a significant number of horizontal trees have been built and installed, in particular in subsea wellhead installations, as a result of the advantages they offer over the conventional vertical tree design. However, a number of problems remain with horizontal trees.

As noted above, horizontal trees are formed with a central, vertically arranged tree body, through which extends the central bore. A horizontal production port and various annulus ports are provided in the tree body. The lower end of the tree body may be formed as an integral connector for securing to a wellhead housing. The upper end of the tree body is invariably formed as a connector or vertical intervention hub, to allow connection to a BOP stack, riser or the like. In view of the wide range of rig and platform assemblies used to service subsea wellheads, the tree body needs to be formed with an upper connector or hub of considerable length, in order to accommodate the variety of connection designs that may be employed. As a result, the body of a horizontal tree is a massive component, the size of which limits the ability to machine and form other features or components. Accordingly, the need to provide the necessary production, annulus and cross-over valves as bolt-on components arises. The massive size of the tree body also limits the extent to which other features may be incorporated into the tree body, such as certain flowloops or cross-over lines.

The inability to include the aforementioned features into the horizontal tree body may detract from the integrity of the tree. This is particularly the case if the production flow path of the known horizontal tree designs is considered. As noted above, it has been the case that the valves necessary to control the production fluid flow cannot necessarily be accommodated within the tree body. Thus, production flow valves have been incorporated using bolt-on valve assemblies. This results in a potential fluid leak path at every joint of the bolt-on assemblies. The potential for a fluid leak is particularly high at the very high fluid pressures encountered in the production flow path, in which fluid is flowing at full well pressure before reaching the production choke. Indeed, an analysis of the known horizontal tree designs shows that the highest integrity of the horizontal tree body extends along the central longitudinal (vertical) bore and not along the production flowpath. While this is of advantage during downhole operations where entry to the well is required through the central bore, such operations occupy only a very minor portion of the working life of the wellhead assembly, with the majority of the time being spent with the well in production mode. Accordingly, the majority of the operations conducted through a wellhead assembly with a horizontal tree will involve using a fluid flowpath through the assembly that comprises one or more potential fluid leak paths.

There is a need for a design of wellhead assembly and horizontal tree that incorporates an improved integrity in the fluid flowpaths through the tree.

SUMMARY

According to at least one embodiment there is provided an assembly for use in a wellhead, the assembly comprising a tree body having an internal bore arranged in use to be aligned with the bore of a wellhead housing; the tree body comprising a lateral bore extending through the tree body from the internal bore; the tree body further comprising means for connecting to a connector so as to align the internal bore of the tree body with an internal bore in the connector, in use the tree body and the connector together forming a horizontal tree.

In use, the tree body of the assembly and the connector are separate components, which when combined, form a horizontal tree that may be used in the same manner as the known horizontal trees described hereinbefore. However, a number of significant advantages arise from the use of a tree body and separate connector, such as a tree re-entry connection.

First, the connector is arranged for connecting to subsea equipment to be used in downhole operations to be conducted. In particular, the connector may be a hub, especially a tree re-entry hub for connection to a BOP stack. At least one embodiment allows the connector, in particular the tree re-entry hub to be tailored to the requirements of the rig or platform to be used, the form of BOP assembly and to suit the other features of the wellhead assembly, for example the BOP guide funnel. A given tree body may thus be fitted with one of a variety of different connectors, to meet the precise requirements of the installation and operator.

Second, the tree body may be manufactured to the end user's requirements and specifications independently of the connector and without the form of the connector needing to be specified. This greatly increases the efficiency of the overall assembly construction and manufacture.

Further, the connector will not be subjected to fluids, such as hydrocarbons produced from the well. Rather, during such operations as installation and workover of the well, the connector is exposed to drilling muds and completion fluids. In addition, the connector will be exposed to such fluids for short durations and, in many cases at pressures below full production pressure of the well. Accordingly, it is possible to reduce the specification of the connector. In comparison with the horizontal trees of the prior art, where the connector portion of the tree body is manufactured to the full specification of the tree body as a whole, this may significantly reduce the size, weight and manufacturing costs of the connector.

As the connector will not be part of the production flowpath of the wellhead installation, the production fluid leaving the wellhead housing, passing through the internal bore of the tree body into the lateral production bore, the joint between the connector and the tree body will not be subjected to production fluid under production conditions and does not present a potential leak path for fluid from the wellhead installation. This in turn allows the connector to be formed from different materials to the tree body, sufficient to meet the reduced specification. This is in contrast to the known horizontal tree designs, in which the entire tree must be forged from a single block of a single material.

Still further, the separation of the connector from the tree body significantly reduces both the size and weight of the tree body, allowing it to be forged and manufactured with many more components integral to the tree body, in contrast to the requirement of conventional designs requiring such components to be provided by way of additional or bolt-on sub-assemblies. In this way, the overall integrity of the major flow paths for fluid through the tree body is significantly increased.

The tree body may comprise some or all of the ports and valves required for the full operation of the wellhead installation. Thus, in at least one embodiment, the tree body comprises at least one valve to control the flow of production fluid through the lateral production bore. It is a requirement of wellhead installations that the production flowpath has at least two independent means for isolating the production path from the well. Indeed, it is a requirement that the wellhead installation should comprise at least two independent means for isolating any hydrocarbon flow from the environment, sometimes referred to as "double barrier isolation." Preferably, the tree body comprises both a primary production valve, also known as a production master valve (PMV), and a secondary production valve, also known as a production wing valve (PWM) or outer master valve (OMV), each of which independently controls the flow of fluid along the production flowpath.

In at least a further embodiment, the tree body comprises a laterally extending bore through the tree body to provide a cross-over flow path. In conventional horizontal tree designs, the cross-over flow path is provided by a separate cross-over assembly mounted on the side of the tree body. By having the cross-over bore formed through the tree body, the integrity of the cross-over flow path is increased, resulting in reduced potential for fluid leaks. Preferably, the tree body is formed to comprise a cross-over valve (XOV) within the tree body to control the flow of fluid along the cross-over flowpath.

It is known to form horizontal trees with annulus passages or bores. Such bores are disclosed, for example in U.S. Pat. No. 5,544,707 and are used to provide a path for fluid from the internal bore of the tree above a tubing hanger to an annulus below the tubing hanger. Valves to control the flow of fluid through the annulus passages may be mounted to the outside of the tree body, as shown in U.S. Pat. No. 5,544,707, or integral with the tree body, as disclosed in U.S. Pat. No. 6,050,339. In a preferred embodiment of the present invention, the tree body is provided with one or more annulus flow passages as known in the art. Preferably, the tree body incorporates at least one valve to control the flow of fluid through the annulus flow passages. It is preferred to provide the tree body with both a primary annulus valve, also known as an annulus master valve (AMV), an a secondary annulus valve, also known as an annulus access valve (AAV) (formerly known as the workover valve), as integral components. Again, this provides the annulus flow path with an increased integrity and reduces the potential for fluid leaks from this path.

The forming and machining of the various bores, ports, and passages extending through the tree body is significantly easier than with the known designs of horizontal tree. In general, the upper connector portion of the known horizontal trees restricts access to the internal bore of the tree, in turn making it difficult to bore and machine the various ports and passages. In the assembly of the disclosed embodiments, the manufacturer of the tree body has significantly improved access to the entire length of the internal bore, allowing all the necessary bores and passages through the tree body to be formed with greater ease and increased accuracy.

In the case of horizontal trees, it is a requirement for operation that two independent isolation means are provided within the tree to seal and isolate the well bore. Reference in this respect is made, for example, to the Norsok Standard Common Requirements for Subsea Christmas Tree Systems, U-CR-003, 1 Dec., 1994. Such isolation means include internal tree caps with plugs, in particular wireline plugs. Conventional horizontal tree designs incorporate one of the two independent isolation means within the internal bore extending through the connector portion of the tree. In the present invention, it is an advantage that two independent isolation means may be included in the tree body, thus fulfilling the operation requirements. This in turn leaves the connector free of internal isolation means. Suitable isolation means for inclusion in the tree body are internal tree caps and wireline plugs.

In use, the tree body is oriented with the internal bore generally vertical, with the means for connection to the connector uppermost. The lower end of the internal bore is connected by suitable means to the exposed end of the wellhead housing. Suitable connection means for mounting to the wellhead housing are known. These may be formed integrally with the tree body during the forging and manufacturing procedure. Alternatively, for ease of manufacture, transport and assembly, the means for connecting to the wellhead housing are preferably separate from the tree body.

At least another embodiment provides a wellhead assembly comprising an assembly as hereinbefore described.

As noted above, the embodiments enable a horizontal tree to be prepared having an integral production flow path with significantly lower potential for fluid leaks from the production fluid flow. Accordingly, in a further aspect, at least one embodiment provides an assembly for use in a wellhead, the assembly comprising a tree body having an internal bore arranged in use to be aligned with the bore of a wellhead housing; the tree body comprising a lateral bore extending through the tree body from the internal bore; the tree body further comprising means for housing a production master valve and a production wing valve within the tree body to control the flow of fluid along the lateral bore.

In order to allow the tree body to be forged and manufactured with the production flow path from the internal bore through the lateral bore fully integral with the tree body (that is not reliant upon externally attached components), it is preferred that the connector of the horizontal tree is a separate component, the tree body having means to connect to the connector. The connector may be any required form of connector, in particular a hub, such as a re-entry hub, for connection to a BOP stack in conventional manner.

In order to provide an integral production fluid flowpath, the tree body comprises valves to control the flow of production fluid through the lateral production bore, the valves being formed integrally with the tree body. Preferably, the tree body comprises both a production master valve (PMV) and a production wing valve (PWV), both of which control the flow of fluid along the production flowpath.

The tree body may be formed with some or all of the other ports and valves required for the full operation of the wellhead installation. Thus, in at least one embodiment, the tree body comprises a laterally extending bore through the tree body to provide a cross-over flow path. In conventional horizontal tree designs, the cross-over flow path is provided by a separate cross-over assembly mounted on the side of the tree body. By having the cross-over bore formed through the tree body, the integrity of the cross-over flow path is increased, resulting in reduced potential for fluid leaks or damage to otherwise protruding flow loops and the like. Preferably, the tree body is formed to comprise a cross-over valve (XOV) to control the flow of fluid along the cross-over flowpath.

In a preferred embodiment, the tree body is provided with one or more annulus flow passages as known in the art. Preferably, the tree body incorporates at least one valve to control the flow of fluid through the annulus flow passages. It is preferred to provide the tree body with both an annulus master valve (AMV) and an annulus access valve (AAV) as integral components. Again, this provides the annulus flow path with an increased integrity and reduces the potential for fluid leaks from this path.

Preferably, two independent isolation means for isolating the well bore are included in the tree body. This in turn may leave the connector free of internal isolation means. Suitable isolation means for inclusion in the tree body are internal tree caps and wireline plugs. Additional isolation means, such as an internal tree cap and wireline plug, may be included in the connector, if desired, to provide emergency or contingency isolation of the well.

In use, the tree body is oriented with the internal bore generally vertical, with the means for connection to the connector uppermost. The lower end of the internal bore is connected by suitable means to the exposed end of the wellhead housing. Suitable connection means for mounting to the wellhead housing are known. These may be formed integrally with the tree body during the forging and manufacturing procedure. Alternatively, for ease of manufacture, transport and assembly, the means for connecting to the wellhead housing are preferably separate from the tree body.

In a further aspect, the present invention provides a wellhead assembly comprising an assembly comprising a tree body having an internal bore arranged in use to be aligned with the bore of a wellhead housing; the tree body comprising a lateral bore extending through the tree body from the internal bore; the tree body further comprising a primary production valve and a secondary production valve within the tree body to control the flow of fluid along the lateral bore.

In general, subsea wellhead installations comprise a choke valve assembly in the production line, the function of which is to reduce the pressure of the production fluid to below well pressure to a level that can be handled by the downstream production installation. It is conventional practice to include such a choke valve assembly in the wellhead assembly. Typically, the choke valve assembly is mounted directly downstream of the production wing valve. In known horizontal tree assemblies, both the production wing valve and the choke valve assembly are components mounted externally to the tree, by means of suitable high pressure connections. It is an advantage that a horizontal tree body is provided that, when installed in a wellhead assembly, provides an integral production fluid flowpath with flow control up to the inlet to the choke valve assembly.

Accordingly, at least a further embodiment provides a wellhead assembly, in particular a subsea wellhead assembly, comprising a wellhead housing having an internal bore therethrough; a horizontal tree assembly, the horizontal tree assembly comprising a tree body having an internal bore aligned with the internal bore of the wellhead housing, the tree body comprising a lateral bore extending from the internal bore through the tree body to provide a production fluid flowpath having an inlet in communication with the internal bore of the wellhead housing and an outlet; the tree body comprising integral flow control means for controlling the flow of production fluid through the production flowpath between the inlet and outlet; and a choke valve assembly having an inlet in direct communication with the outlet of the production fluid flowpath; the arrangement providing in use an integral flowpath for production fluid from the internal bore of the wellhead housing to the inlet of the choke valve assembly.

As noted above, known designs of horizontal tree require an external assembly connected to the exterior of the tree body to provide the required cross-over path. As also noted, it is an advantage of the disclosed embodiments that a horizontal tree is provided that has an integral cross-over flowpath extending through the tree body. Accordingly, in a further aspect, the embodiment provides an assembly for use in a wellhead, the assembly comprising a tree body having an internal bore arranged in use to be aligned with the bore of a wellhead housing; the tree body comprising a lateral bore extending through the tree body from the internal bore; the tree body further comprising a cross-over bore extending laterally through the tree body.

The function of a cross-over bore is to provide for a flowpath to circulate fluid through the production pipeline and annulus pipeline. In addition, the cross-over bore allows the pressure in the annulus flowpath to be equalised with the pressure in the production flowpath. Further, the cross-over bore is used to circulate fluid between a workover test string and the annulus return path, for example to flush the aforementioned lines, change or condition fluids, such as drilling muds, in the lines of the well.

The flow of fluid through the cross-over bore is controlled by one or more cross-over valves. In a preferred arrangement, the tree body further comprises provision for at least one cross-over valve to be mounted integrally within the tree body. In this way, the integrity of the cross-over path is maintained and the possible leakage of fluid from the wellhead assembly significantly reduced.

As discussed above, in order to allow the tree body to be forged and manufactured with the production flow path from the internal bore through the lateral bore fully integral with the tree body (that is not reliant upon externally attached components), it is preferred that the connector of the horizontal tree is a separate component, the tree body having means to connect to the connector. The connector may be any required form of connector, in particular a hub, such as a re-entry hub, for connection to a BOP stack in conventional manner.

In order to provide an integral production fluid flowpath, the tree body preferably comprises the necessary valves to control the flow of production fluid through the lateral production bore. Preferably, the tree body comprises both a production master valve (PMV) and a production wing valve (PWV), both of which control the flow of fluid along the production flowpath.

In a preferred embodiment, the tree body is provided with one or more annulus flow passages as known in the art. Preferably, the tree body incorporates at least one valve to control the flow of fluid through the annulus flow passages. It is preferred to provide the tree body with both an annulus master valve (AMV) and an annulus access valve (AAV) as integral components. Again, this provides the annulus flow path with an increased integrity and reduces the potential for fluid leaks from this path.

Preferably, two independent isolation means for isolating the well bore are included in the tree body. This in turn leaves the connector free of internal isolation means. Suitable isolation means for inclusion in the tree body are internal tree caps and wireline plugs.

In use, the tree body is oriented with the internal bore generally vertical, with the means for connection to the connector uppermost. The lower end of the internal bore is connected by suitable means to the exposed end of the wellhead housing. Suitable connection means for mounting to the wellhead housing are known. These may be formed integrally with the tree body during the forging and manufacturing procedure. Alternatively, for ease of manufacture, transport and assembly, the means for connecting to the wellhead housing are preferably separate from the tree body.

As noted above, the embodiments are particularly suitable and offer significant advantages in the manufacture, shipping, and installation of wellhead installations in remote locations, in particular subsea wellheads where the installation is a considerable distance from the rig or platform operating the well. The assemblies of the present invention are particularly advantageous when used in deep water locations, that is wellhead installations at a depth of up to 3,000 m (10,0000 feet).

BRIEF DESCRIPTION OF THE DRAWINGS

The embodiments will now be described, by way of example only, having reference to the accompanying drawings, in which.

DETAILED DESCRIPTION OF THE EMBODIMENTS

Figure 1:
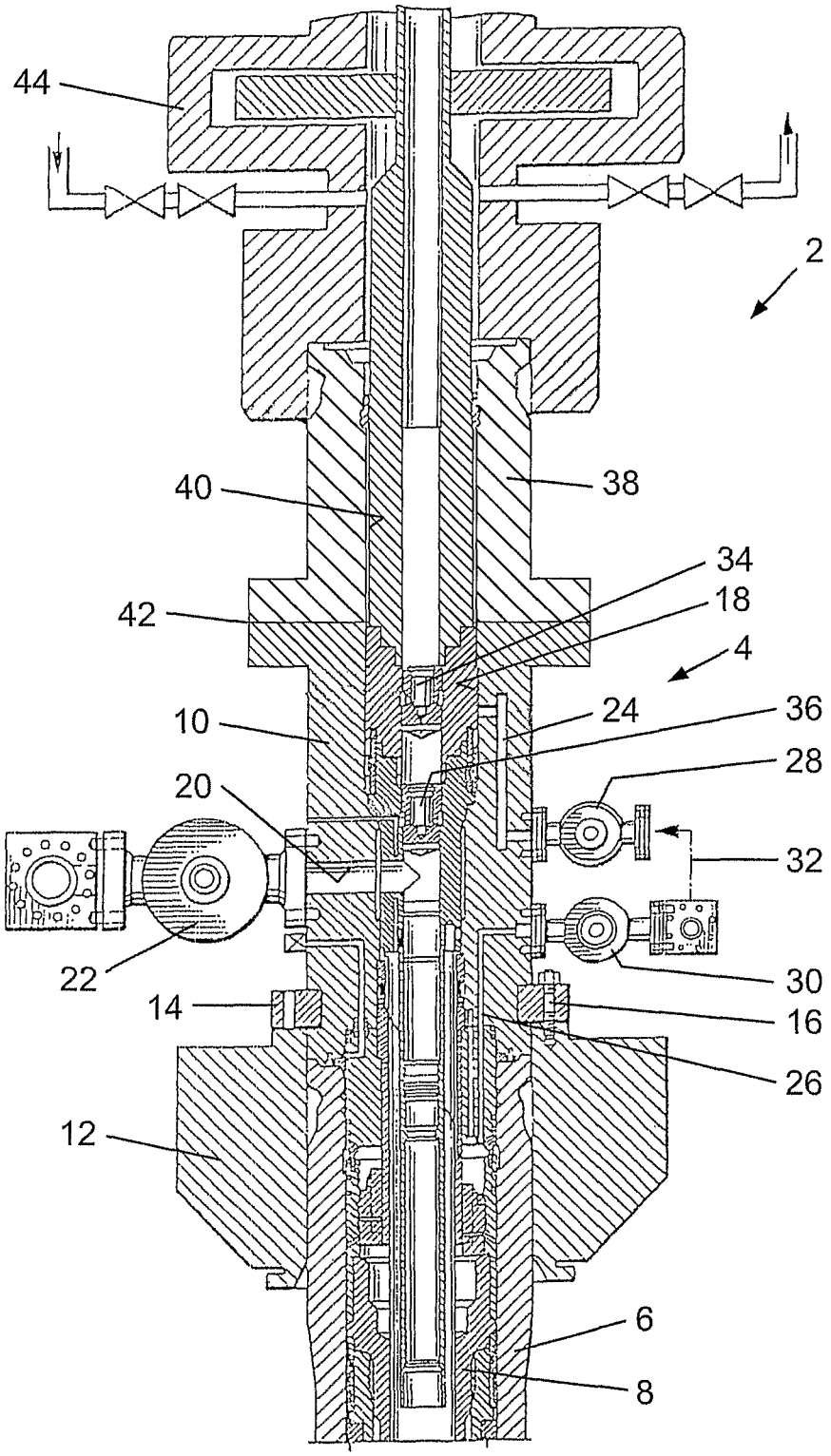
FIG. 1 is a cross-sectional view of a wellhead assembly comprising a horizontal tree assembly according to a first embodiment.

Referring to FIG. 1, there is shown a wellhead assembly, generally indicated as 2, comprising a horizontal tree assembly, generally indicated as 4, according to a first embodiment. Shown in FIG. 1 is the upper end of a cased well having a wellhead housing 6, in which an uppermost production casing hanger 8 is mounted in conventional manner.

The horizontal tree assembly 4 comprises a tree body 10, mounted to the upper end of the wellhead housing 6 by means of a production connector 12, a connection ring 14 and bolts 16.

The tree body 10 has an internal bore 18, extending along the central longitudinal axis of the tree body and aligned with the internal bore in the wellhead housing 6. A lateral bore 20 extends from the internal bore 18 through the tree body 10. In operation, the lateral bore 20 provides a flowpath for production fluid from the wellhead casing 6 via the internal bore 18 of the tree body 10. A production master valve 22 is mounted to the exterior of the tree body 10 at the opening of the lateral bore 20 and controls the fluid of production fluid through the lateral bore and from the wellhead assembly.

Annulus flow passages 24 and 26 extend through the tree body 10 above and below the lateral bore 20, respectively, and have exterior openings. Annulus control valves 28 and 30 are mounted to the exterior of the tree body 10 to control the flow of fluids into and out of the annulus flow passages 24 and 26, respectively. A circulation path, arranged external to the tree body 10 and connecting the annulus flow passages 24 and 26 is indicated by dotted line 32 in FIG. 1.

Two wireline plugs 34 and 36 are shown installed in the internal bore 18 of the tree body 10 above the lateral bore 20. The wireline plugs 34 and 36 provide independent isolation of the components described hereafter, and ultimately the environment, from hydrocarbons or other fluids in the production flowpath.

The horizontal tree assembly 4 further comprises, as a connector, a well re-entry hub 38 mounted on the tree body by means of a flange connection 42 and bolts (not shown). The hub 38 has an internal bore 40 aligned with the internal bore 18 of the tree body. Together, the tree body 10 and the hub 38 form the horizontal tree assembly and function in the same manner as known horizontal trees, for example those described in U.S. Pat. No. 5,544,707.

The hub 38 may be provided with a further isolation means, for example an internal tree cap with wireline plugs, as demanded by the operations being carried out, in order to supplement the two isolation plugs 34 and 36 in the tree body 10. A blowout preventer (BOP) 44 of conventional design is shown mounted to the hub 38, in conventional manner. It will be appreciated that the hub 38 may be arranged to couple with any equipment required during the lifetime of the well.

The embodiment shown in FIG. 1 is arranged with a minimal number of components integral with the tree body. In particular, it will be noted that the production and annulus valves 22, 28, 30 are external to the tree body 10. While this arrangement provides a tree body of reduced size, it is preferred in many cases, to form the tree body with many integral components, as will be described and shown in the following embodiments.

Figure 2:
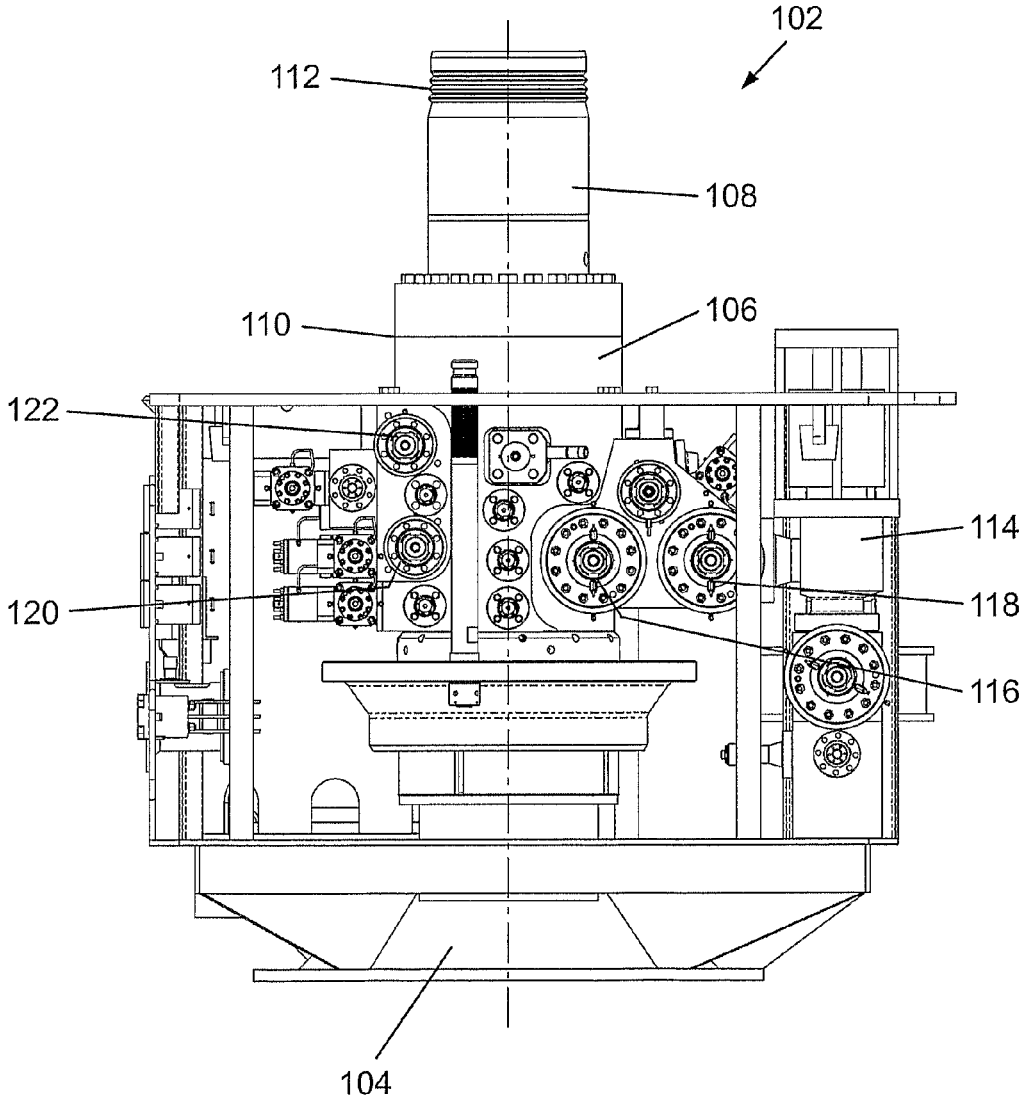
FIG. 2 is a side elevation of a wellhead assembly according to a second embodiment.

Turning to FIG. 2, there is shown a side elevation of a wellhead assembly according to a preferred embodiment. The wellhead assembly, generally indicated as 102, comprises a conical guide 104, which in use is used to guide the assembly onto a subsea wellhead, so as to mount the wellhead assembly in a similar manner to that shown in FIG. 1. The wellhead assembly 102 comprises a tree body 106 and a re-entry hub 108 mounted thereto by a flange assembly 110. The re-entry hub 108 is formed with an upper end portion 112, as viewed in FIG. 2, of conventional design to connect to a BOP or the like.

A production choke assembly 114, which may be of conventional design, is shown in FIG. 2 connected to the production outlet of the tree body 106.

Also shown in FIG. 2 are the actuators for the various valves integral to the tree body 106, including a primary production or production master valve (PMV) 116, a secondary production or production wing valve (PWV) 118, annulus valves 120, 122 and a cross-over valve 123.

Figure 3:
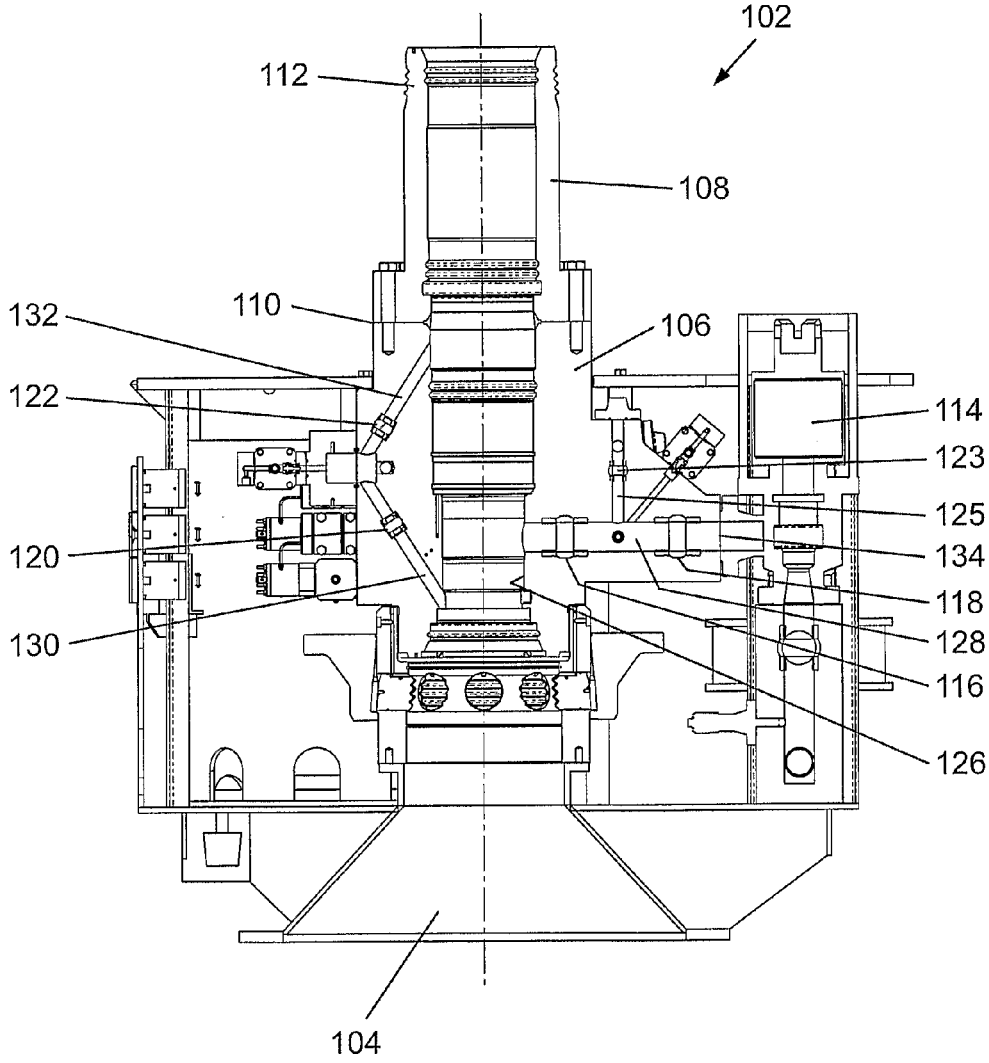
FIG. 3 is a vertical cross-sectional view of the wellhead assembly of FIG. 2.

The components of the wellhead assembly 104 of FIG. 2 are shown in vertical cross-section in FIG. 3. As will be seen in FIG. 3, the tree body 106 has an internal bore 126 extending vertically, as shown in the figure. A lateral bore 128 extends through the tree body 106 from the internal bore. The primary and secondary production master valves 116 and 118 are formed in the tree body, appearing in FIG. 3 as cavities, having valve seats machined therein. Additional bores (not shown in FIG. 3) extend into the tree body 106 and accommodate components of the valves, in particular the valve stem and gate and provide access for actuators to position the valve stem and gate, as required.

The tree body 106 further includes annulus flowpaths formed by bores 130 and 132, with their respective control valves 120 and 122. The bores 130 and 132 are formed with cavities to form the respective valves, in same manner as the production valves, as described above. A bore 125 is machined into the tree body 106, fluid flow through which is controlled by the cross-over valve 123.

The choke assembly 114 is connected to the exterior of the tree body 106 by a conventional connection 134. It will be noted that the production flowpath through the internal bore 126 of the tree body 106 and the lateral bore 128 up to the connection at the inlet of the choke assembly 114 is an integral flowpath, with no joints. It will thus be appreciated that the integrity of the production flowpath can thus be significantly greater than a conventional production flowpath comprising several separate components. This in turn can significantly reduce the potential for leaks of fluids, in particular hydrocarbons, from the wellhead assembly.

The means for isolating the internal bore 126 of the tree body above the lateral bore 128 have been omitted from FIG. 3, for reasons of clarity. However, they may be internal tree cap and wireline plugs installations as described above in connection with FIG. 1.

Figure 4:
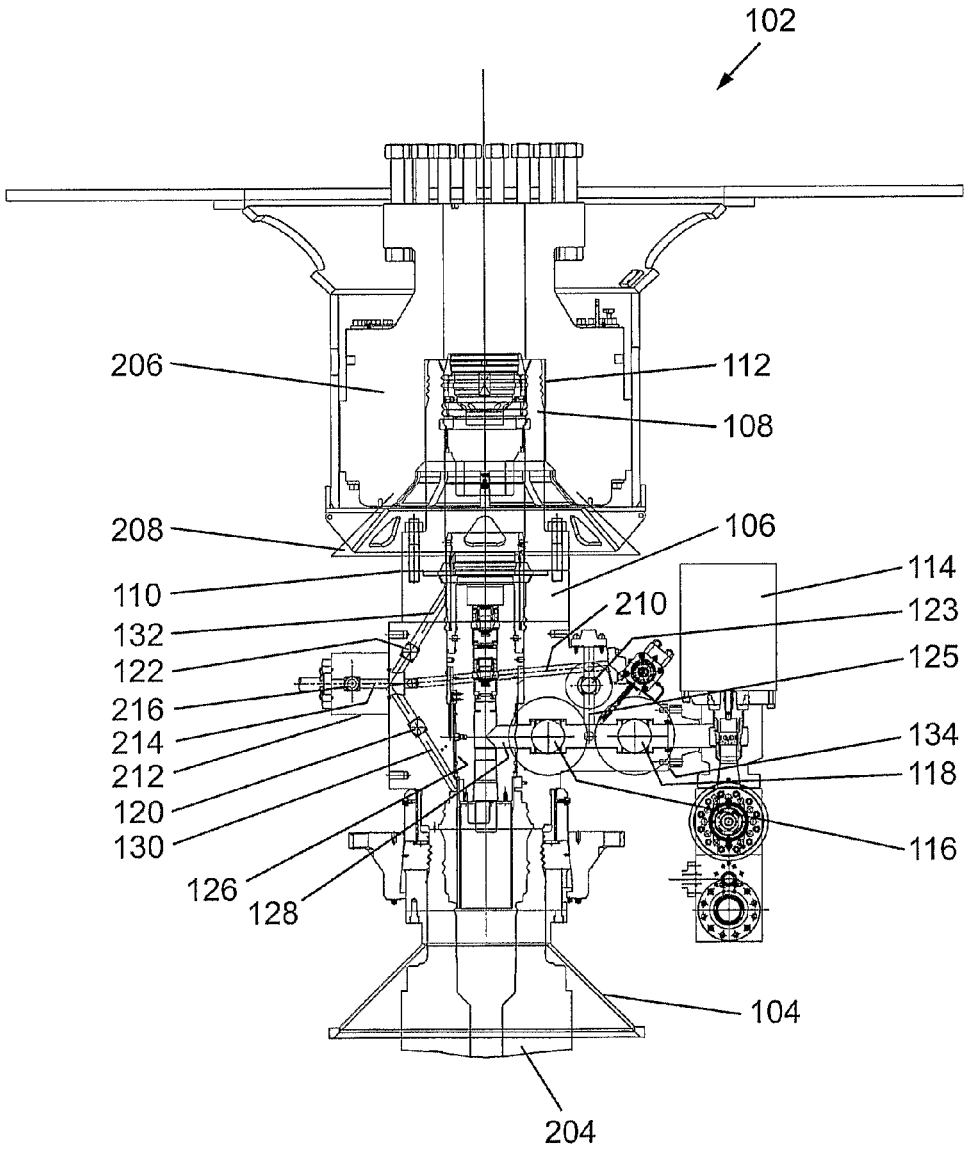
FIG. 4 is a vertical cross-sectional view of a wellhead assembly of a further embodiment.

Turning to FIG. 4, there is shown a wellhead assembly, generally indicated as 202 in place on a subsea wellhead housing, 204. The components of the wellhead assembly 202 are generally as shown in FIGS. 2 and 3 and described hereinbefore. Accordingly, components common to the assemblies of FIGS. 3 and 4 are indicated using the same reference numerals. The differences between the embodiments shown in FIGS. 3 and 4 are as follows:

The assembly 202 as shown in FIG. 4 further comprises a BOP 206 mounted on the upper end portion 112 of the hub 108. The BOP 206 is of conventional design and comprises a guide funnel 208 for ease of landing the BOP on the hub 108. The tree body 106 of the assembly of FIG. 4 comprises an integral cross-over bore 210, shown in more detail in FIG. 5. The cross-over bore 210 extends laterally within the tree body 106 from the junction of the annulus bores 130 and 132. The cross-over bore 210 intersects the bore 125 in which is formed the integral cross-over valve 123, as hereinbefore described with respect to the production valves. The cross-over bore 210 and the bore 125 provide a fluid connection between the lateral bore 128 and the annulus bores 130 and 132. Fluid flow through this cross-over flowpath is controlled by the cross-over valve 123.

An annulus wing valve block 212 is connected to the exterior of the tree body 106 and comprises an annulus bore 214 and an annulus wing valve 216, controlling the flow of fluid through the annulus bores 130 and 132.

Providing the cross-over flowpath through bores and valves internal to and integral with the tree body again increases the integrity of the horizontal tree assembly and reduces the potential for leaks of hydrocarbons and other well fluids into the environment.

Figure 5:
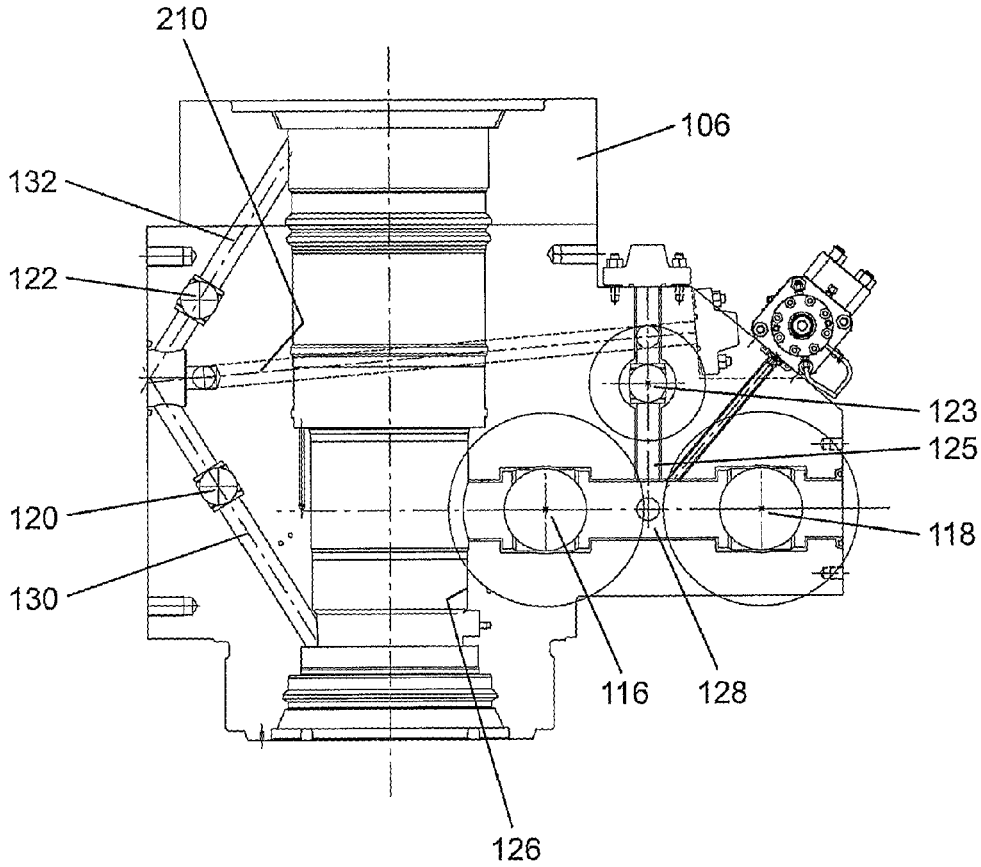
FIG. 5 is a vertical cross-sectional view of the tree body or the wellhead assembly of FIG. 4.

As will be appreciated from FIG. 5, the tree body 106, while comprising integral flowpaths and control valves, is also a compact and flexible component, that can be designed and manufactured to suit a particular need. This flexibility is further enhanced by the ability to combine different tree bodies and different hubs, to meet specific end use requirements.

Figure 6:
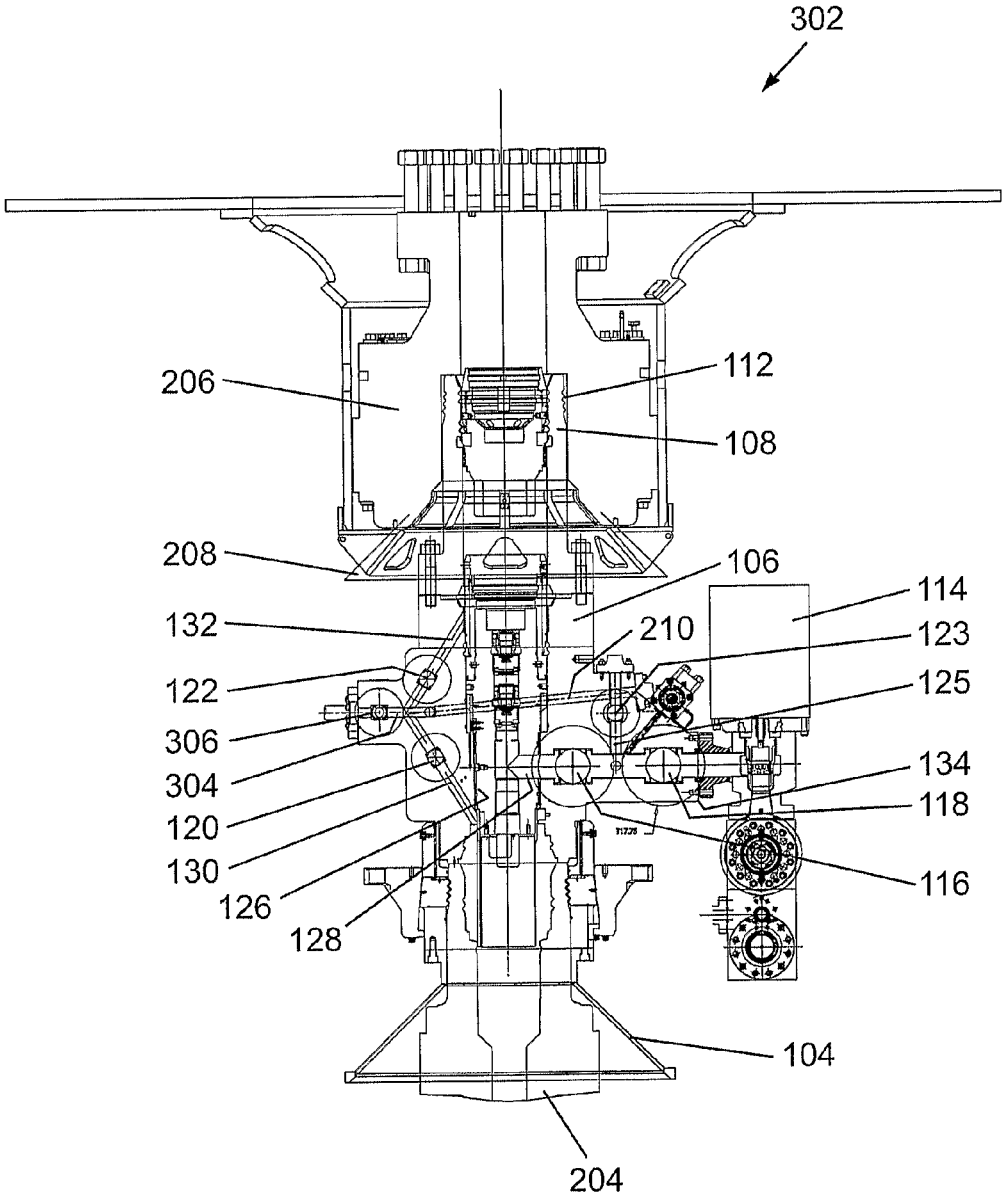
FIG. 6 is a vertical cross-section view of a wellhead assembly of a further embodiment.

An alternative embodiment is shown in FIG. 6. In FIG. 6, there is shown a wellhead assembly, generally indicated as 302 in place on a subsea wellhead housing. The components of the wellhead assembly 302 are generally as shown in FIGS. 4 and 5 and described hereinbefore. Accordingly, components common to the assemblies of FIGS. 4 and 5 are indicated using the same reference numerals. The differences between the embodiments shown in FIGS. 4 and 6 are as follows:

The tree body 106 of the assembly 302 of FIG. 6 comprises an integral annulus wing valve arrangement. Thus, an annulus bore 304 is formed in the tree body 106, extending from the junction of the two annulus bores 130 and 132. The tree body 106 is further provided with an integral annulus wing valve 306, formed in the tree body as hereinbefore described with reference to the other integral valves. The integral annulus wing valve 306 provides a control of the fluid flow through the annulus bores 130, 132 and 304, in addition to the control provided by integral annulus valves 120 and 122. It will be appreciated that the tree body 106, by having fully integral annulus valves 120, 122, 306 and annulus bores 130, 132, 304, provides an annulus flowpath with a very high degree of integrity, thereby minimising the potential for fluid leaks from within the tree body into the environment.

It will be seen that the assembly of FIG. 6 comprises a tree body of the highest integrity, having all the production, annulus and cross-over bores and their respective primary and secondary flow control valves formed integrally within the tree body.

The invention claimed is:

1. An assembly for use on a wellhead including a wellhead housing with a vertical bore, the assembly including:

a horizontal tree body attachable to the top of the wellhead housing and including:

an internal vertical bore with a bottom opening and arranged in use to be aligned in-line with and to be in fluid communication with the wellhead housing vertical bore;

a lateral bore extending through the tree body from the internal bore; and a means for connecting on the top portion of the horizontal tree body;

a connector separate from and connectable to and disconnectable from the tree body by the means for connecting so as to align the internal bore of the tree body with an internal bore in the connector; and wherein in normal operation all production fluid flows from the wellhead housing vertical bore, into the tree body internal vertical bore through the bottom opening, and out the tree body lateral bore.

2. The assembly according to claim 1, wherein the connector is a hub.

3. The assembly according to claim 2, wherein the hub is a tree re-entry hub connectable to a blowout preventer.

4. The assembly according to claim 1, further including at least one valve within the tree body to control the flow of fluid through the lateral bore.

5. The assembly according to claim 4, including a primary production master valve and a secondary production master valve to control the flow of fluid through the lateral bore.

6. The assembly according to claim 1, wherein the tree body includes a laterally extending bore which, in use, provides a cross-over fluid flowpath.

7. The assembly according to claim 6, further including at least one valve within the tree body to control the flow of fluid along through the laterally extending bore.

8. The assembly according to claim 1, wherein the tree body includes at least one annulus passage.

9. The assembly according to claim 8, further including at least one valve within the tree body to control the flow of fluid along the or each annulus passage.

10. The assembly according to claim 9, wherein the tree body includes a primary annulus valve and an annulus access valve within the tree body.

11. A wellhead assembly for producing production fluid, including:

a wellhead housing including an internal vertical bore;

an assembly mounted on the wellhead housing, the assembly including a horizontal tree body including:

an internal vertical bore with a bottom opening being alignable in-line with and to receive production fluid from the internal vertical bore of the wellhead housing; and a lateral bore extending through the tree body from the internal bore;

a connector separate from and connectable to and disconnectable from the tree body and also including an internal bore alignable with the internal vertical bore of the tree; and wherein in normal operation all production fluid flows from the wellhead housing vertical bore, into the tree body internal vertical bore through the bottom opening, and out the tree body lateral bore.

12. The wellhead assembly according to claim 11, further including a blowout preventer mounted on the connector.

13. The wellhead assembly according to claim 11, wherein the connector is of a different material to the tree body.

14. An assembly for use with a wellhead including a wellhead housing with an internal vertical bore to produce production fluid, the assembly including:

a horizontal tree body including:

an internal vertical bore with a bottom opening arranged in use to be aligned in-line with and to receive production fluid from the wellhead housing vertical bore;

a lateral bore extending through the horizontal tree body from the internal vertical bore; and a primary production valve and a secondary production valve within the tree body to control the flow of fluid along the lateral bore;

a connector separate from and connectable to and disconnectable from the tree body and also including an internal bore alignable with the internal vertical bore of the tree body; and wherein in normal operation all production fluid flows from the wellhead housing vertical bore, into the tree body internal vertical bore through the bottom opening, and out the tree body lateral bore.

15. The assembly according to claim 14, wherein the tree body includes means for connecting to the separate connector so as to align the internal vertical bore of the tree body with an internal bore in the connector.

16. The assembly according to claim 14, wherein the tree body includes a laterally extending bore which, in use, provides a cross-over fluid flowpath.

17. The assembly according to claim 16, further including at least one valve within the tree body to control the flow of fluid along through the laterally extending bore.

18. The assembly according to claim 14, wherein the tree body includes at least one annulus passage.

19. The assembly according to claim 18, further including at least one valve within the tree body to control the flow of fluid along the or each annulus passage.

20. The assembly according to claim 19, wherein the tree body includes a primary annulus valve and an annulus access valve within the tree body.

21. A wellhead assembly for producing production fluids, including:

a wellhead housing including an internal vertical bore;

an assembly mounted on the wellhead housing, the assembly including a horizontal tree body including:

an internal bore, a first end of the internal bore of the assembly being aligned in-line with and to receive production fluid from the internal vertical bore of the wellhead housing;

a lateral bore extending through the horizontal tree body from the internal vertical bore; and a primary production valve and a secondary production valve within the horizontal tree body to control the flow of fluid along the lateral bore;

a means for providing a connection to a second end of the internal vertical bore in the tree body;

a connector separate from and connectable to and disconnectable from the tree body by the means for providing a connection and also including an internal bore alignable with the internal bore of the tree; and wherein in normal operation all production fluid flows from the wellhead housing internal vertical bore, into the tree body internal bore through the first end, and out the tree body lateral bore.

22. The wellhead assembly according to claim 21, wherein the means for providing a connection to the second end of the internal bore includes a connector, separate from the tree body, the tree body including means for connecting to the connector, the connector including an internal bore aligned with the internal bore of the assembly.

23. The wellhead assembly according to claim 22, further including a blowout preventer mounted on the connector.

24. The wellhead assembly according to claim 22, wherein the connector is of a different material to the tree body.

25. A wellhead assembly for producing production fluid, including:

a wellhead housing including an internal vertical bore therethrough;

a horizontal tree assembly, the horizontal tree assembly including a tree body including:

an internal vertical bore with a bottom opening aligned in-line with and to receive production fluid from the internal vertical bore of the wellhead housing;

a lateral bore extending from the internal bore through the tree body to provide a production fluid flowpath including an inlet in communication with the internal vertical bore of the wellhead housing and an outlet; and integral flow control means for controlling the flow of production fluid through the production flowpath between the inlet and outlet;

a choke valve assembly including an inlet in direct communication with the outlet of the production fluid flowpath;

the arrangement providing in use an integral flowpath for production fluid from the internal bore of the wellhead housing to the inlet of the choke valve assembly;

a connector separate from and connectable to and disconnectable from the tree body and also including an internal bore alignable with the internal vertical bore of the tree; and wherein in normal operation all production fluid flows from the wellhead housing internal vertical bore, into the tree body internal vertical bore through the bottom opening, and out the tree body lateral bore.

26. An assembly for use on a wellhead including a wellhead housing including a vertical bore to produce production fluids, the assembly including:

a horizontal tree body including:

an internal vertical bore including a bottom opening and arranged in use to be aligned in-line with and receive production fluid from the vertical bore of the wellhead housing;

a lateral bore extending through the tree body from the internal vertical bore; and a cross-over bore extending laterally through the tree body;

a connector, separate from and connectable to and disconnectable from the horizontal tree body, the connector including an internal bore alignable in-line with the horizontal tree body vertical internal bore; and wherein in normal operation all production fluid flows from the wellhead housing vertical bore, into the tree body internal vertical bore through the bottom opening, and out the tree body lateral bore.

27. The assembly according to claim 26, wherein the tree body includes one or more valves for controlling the flow of fluid through the cross-over bore.

28. The assembly according to claim 26, further including at least one valve within the tree body to control the flow of fluid through the lateral bore.

29. The assembly according to claim 28, including a primary production valve and a secondary production valve to control the flow of fluid through the lateral bore.

30. The assembly according to claim 26, wherein the tree body includes at least one annulus passage.

31. The assembly according to claim 30, further including at least one valve within the tree body to control the flow of fluid along the or each annulus passage.

32. The assembly according to claim 26, wherein the tree body includes means for connecting to the connector so as to align the internal bore of the tree body with the internal bore in the connector.

33. A wellhead assembly for producing production fluid, including:

a wellhead housing including an internal vertical bore;

an assembly mounted on the wellhead housing and including a tree body including:

an internal vertical bore, a first end of the internal bore of the assembly being aligned in-line with and to receive production fluid from the internal bore of the wellhead housing;

a lateral bore extending through the tree body from the internal bore; and a cross-over bore extending laterally through the tree body;

a means for providing a connection to a second end of the internal bore in the tree body;

a connector separate from and connectable to and disconnectable from the tree body by the means for providing a connection and also including an internal bore alignable with the internal vertical bore of the tree; and wherein in normal operation all production fluid flows from the wellhead housing vertical bore, into the tree body internal vertical bore through the first end, and out the tree body lateral bore.

34. The wellhead assembly according to claim 33, wherein the means for providing a connection to the second end of the internal bore includes a connector, separate from the tree body, the tree body including means for connecting to the connector, the connector including an internal bore aligned with the internal bore of the assembly.

35. The wellhead assembly according to claim 34, further including a blowout preventer mounted on the connector.

36. The wellhead assembly according to claim 34, wherein the connector is of a different material to the tree body.

* * * * *